US005479730A

United States Patent [19]

Gogan

[11] Patent Number: 5,479,730

[45] Date of Patent: Jan. 2, 1996

[54] SNOWBLOWER ATTACHMENT FOR A PICKUP TRUCK

[76] Inventor: James R. Gogan, 9-11th Ave., Madawaska, Me. 04756

[21] Appl. No.: 254,556

[22] Filed: Jun. 6, 1994

[51] Int. Cl.[6] ..... E01H 5/04

[52] U.S. Cl. ..... 37/231; 37/260; 172/273; 172/817

[58] Field of Search ..... 37/260, 261, 231, 37/232, 240, 241, 262; 172/273, 817; 293/102, 142

[56] References Cited

U.S. PATENT DOCUMENTS

| | | | |
|---|---|---|---|
| 3,075,813 | 1/1963 | Vohl | 37/260 |
| 3,285,625 | 11/1966 | Krueger | 37/231 X |
| 4,391,052 | 7/1983 | Guy, Jr. | 37/261 X |
| 4,549,365 | 10/1985 | Johnson | 37/260 X |
| 4,869,003 | 9/1989 | O'Loughlin | 37/255 |
| 4,991,323 | 2/1991 | Benkler | 37/231 X |
| 5,046,271 | 9/1991 | Daniels | 37/231 |
| 5,075,988 | 12/1991 | Ciula | 37/231 |
| 5,125,174 | 6/1992 | Watson et al. | 37/231 |
| 5,195,261 | 3/1993 | Vachon | 37/231 |

*Primary Examiner*—Terry Lee Melius
*Assistant Examiner*—Victor Batson

[57] ABSTRACT

A snowblower attachment for a pickup truck comprising, in combination: a rearward support couplable with respect to the front end of a pickup truck, the rearward support including a central horizontal post, removably attachable to the front end of a pickup truck and extending forwardly thereof, a pair of vertically extending posts spaced parallel with each other secured at a central extent to the forward end of the horizontal post; a forward support including a base plate having a rearward end with a hinge pin coupling the rearward end of the forward support with the forward end of the rearward support, the forward support having a downwardly curved forward end providing a curved cross-sectional configuration, parallel side plates at the external sides of the forward end and an upper curved end forming, in association with the lower curved portion and side panels, a housing, the forward support also having a chimney extending in a vertical orientation with an upper free end formed with a curved end and a pivotable baffle, the chimney also having a lower end in operative association with the rearward end of the housing; an auger positioned in the housing for rotation about a horizontal axis, the auger also including a support shaft secured rotating the auger within the side plates; and a motor positioned on the rearward end of the forward support, the motor having a drive shaft with a first end secured to the motor and a second end with a gearing assembly adapted to rotate the auger, a central portion of the drive shaft including fan.

1 Claim, 5 Drawing Sheets

SNOWBLOWER ATTACHMENT FOR A PICKUP TRUCK

BACKGROUND OF THE INVENTION

1. Field of the Invention

The present invention relates to a snowblower attachment for a pickup truck and more particularly pertains to blowing snow along the path of travel by an auger mechanism powered for rotation by mechanisms supported from the forward end of a pickup truck while providing the forward motion of the snowblower by the truck from which it is supported.

2. Description of the Prior Art

The use of snowblowers of various designs and configurations is known in the prior art. More specifically, snowblowers of various designs and configurations heretofore devised and utilized for the purpose of piling snow through a wide variety of mechanisms receiving power from a wide variety of sources are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,193,296 to Reilley a snow plow attachment.

U.S. Pat. No. 5,182,830 to Viola discloses a truck mounted pavement sweeping brush.

U.S. Pat. No. 5,018,284 to Mikami discloses a snow plow for vehicles.

U.S. Pat. No. 4,391,052 to Guy, Jr. discloses a snow blower.

U.S. Pat. No. 4,143,475 to Schmidt discloses a snow blower.

In this respect, the snowblower attachment for a pickup truck according to the present invention substantially departs from the conventional concepts and designs of the prior art, and in doing so provides an apparatus primarily developed for the purpose of blowing snow along the path of travel by an auger mechanism powered for rotation by mechanisms supported from the forward end of a pickup truck while providing the forward motion of the snowblower by the truck from which it is supported.

Therefore, it can be appreciated that there exists a continuing need for new and improved snowblower attachment for a pickup truck which can be used for blowing snow along the path of travel by an auger mechanism powered for rotation by mechanisms supported from the forward end of a pickup truck while providing the forward motion of the snowblower by the truck from which it is supported. In this regard, the present invention substantially fulfills this need.

SUMMARY OF THE INVENTION

In view of the foregoing disadvantages inherent in the known types of snowblowers of various designs and configurations now present in the prior art, the present invention provides an improved snowblower attachment for a pickup truck. As such, the general purpose of the present invention, which will be described subsequently in greater detail, is to provide a new and improved snowblower attachment for a pickup truck and method which has all the advantages of the prior art and none of the disadvantages.

To attain this the present invention essentially comprises a snowblower attachment for a pickup truck comprising, in combination: a rearward support couplable with respect to the front end of a pickup truck, the rearward support including a central horizontal post, removably attachable to the front end of a pickup truck and extending forwardly thereof, a pair of vertically extending posts spaced parallel with each other secured at a central extent to the forward end of the horizontal post with lateral supports with an arcuate shape secured at their rearward ends to an intermediate extent of the horizontal post and at their forward ends to the lower ends of the vertical posts; a forward support including a base plate having a rearward end with a hinge pin coupling the rearward end of the forward support with the forward end of the rearward support, the forward support having a downwardly curved forward end providing a curved cross-sectional configuration, parallel side plates at the external sides of the forward end and an upper curved end forming, in association with the lower curved portion and side panels, a housing, the forward support also having a chimney extending in a vertical orientation with an upper free end formed with a curved end and a pivotable baffle, the chimney also having a lower end in operative association with the rearward end of the housing; an auger positioned in the housing for rotation about a horizontal axis, the auger also including a support shaft secured rotating the auger within the side plates; a motor positioned on the rearward end of the forward support, the motor having a drive shaft with a first end secured to the motor and a second end with a gearing assembly adapted to rotate the auger, a central portion of the drive shaft including fan blades located at an interface location between the housing and the chimney; a pair of chain assemblies having their lower ends coupled to the forward support and having their upper ends secured to a yoke at an upper extent of the vertical posts; a piston having its lower end secured to an intermediate position between the vertical posts and its upper end secured with respect to the yolk to vary the angular orientation of the forward support; and controls for the motor and piston located within the cab of the vehicle supporting the device.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an objective of the present invention to provide a new and improved snowblower attachment for a pickup truck which has all the advantages of the prior art snowblowers of various designs and configurations and none of the disadvantages.

It is another object of the present invention to provide a new and improved snowblower attachment for a pickup truck which may be easily and efficiently manufactured and marketed.

It is further object of the present invention to provide a new and improved snowblower attachment for a pickup truck which is of durable and reliable constructions.

An even further object of the present invention is to provide a new and improved snowblower attachment for a pickup truck which is susceptible of a low cost of manufacture with regard to both materials and labor, and which accordingly is then susceptible of low prices of sale for the consuming public, thereby making such snowblower attachment for a pickup truck economically available to the buying public.

Still yet another object of the present invention is to provide a new and improved snowblower attachment for a pickup truck which provides in the apparatuses and methods of the prior art some of the advantages thereof, while simultaneously overcoming some of the disadvantages normally associated therewith.

Still another object of the present invention is to blow snow along the path of travel by an auger mechanism powered for rotation by mechanisms supported from the forward end of a pickup truck while providing the forward motion of the snowblower by the truck from which it is supported.

Lastly, it is an object of the present invention to provide a new and improved snowblower attachment for a pickup truck comprising, in combination: a rearward support couplable with respect to the front end of a pickup truck, the rearward support including a central horizontal post, removably attachable to the front end of a pickup truck and extending forwardly thereof, a pair of vertically extending posts spaced parallel with each other secured at a central extent to the forward end of the horizontal post; a forward support including a base plate having a rearward end with a hinge pin coupling the rearward end of the forward support with the forward end of the rearward support, the forward support having a downwardly curved forward end providing a curved cross-sectional configuration, parallel side plates at the external sides of the forward end and an upper curved end forming, in association with the lower curved portion and side panels, a housing, the forward support also having a chimney extending in a vertical orientation with an upper free end formed with a curved end and a pivotable baffle, the chimney also having a lower end in operative association with the rearward end of the housing; an auger positioned in the housing for rotation about a horizontal axis, the auger also including a support shaft secured rotating the auger within the side plates; and a motor positioned on the rearward end of the forward support, the motor having a drive shaft with a first end secured to the motor and a second end with a gearing assembly adapted to rotate the auger, a central portion of the drive shaft including a fan.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objective other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
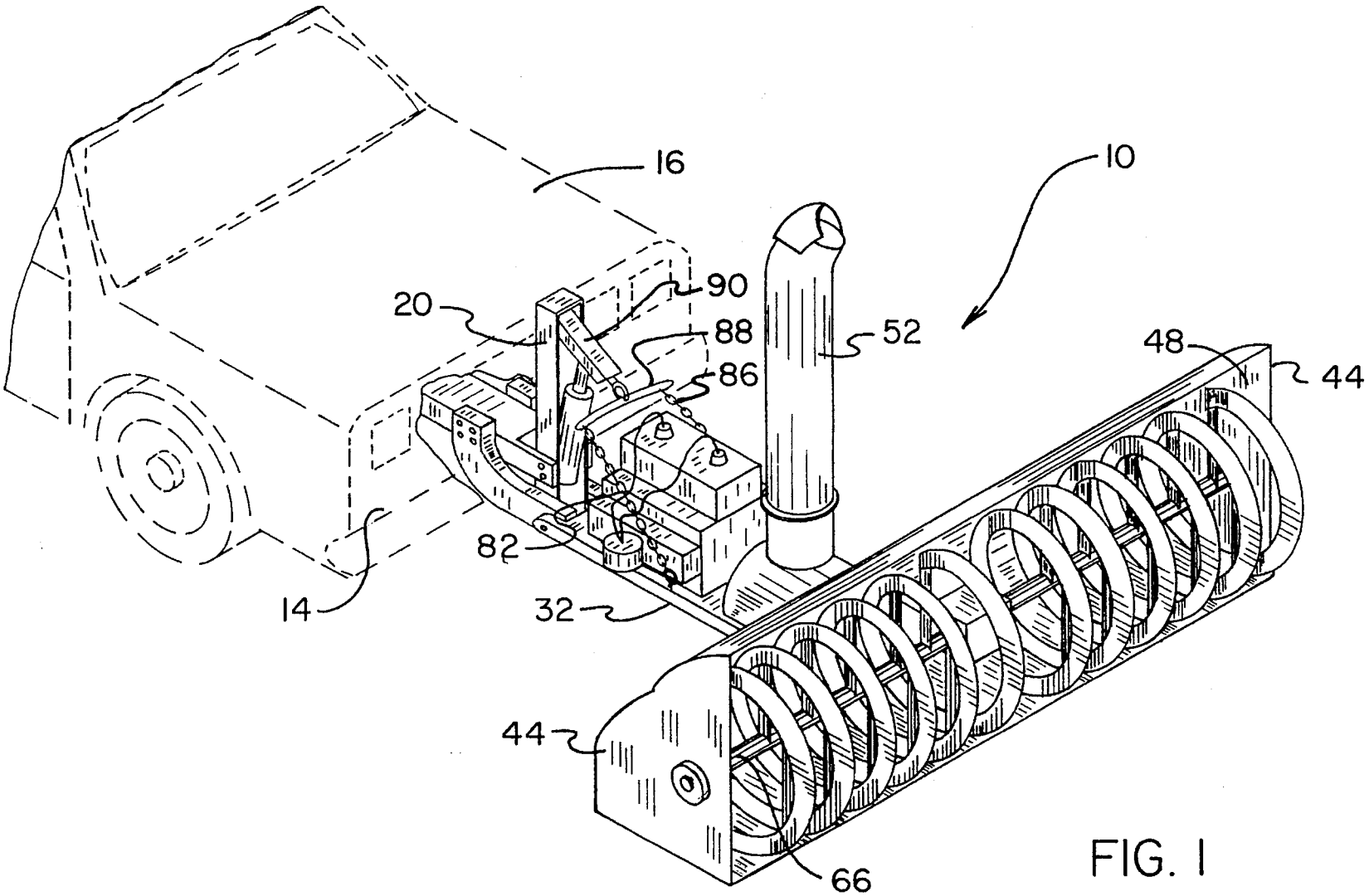
FIG. 1 is a perspective illustration of the preferred embodiment of the snowblower attachment for a pickup truck constructed in accordance with the principles of the present invention.
Figure 2:
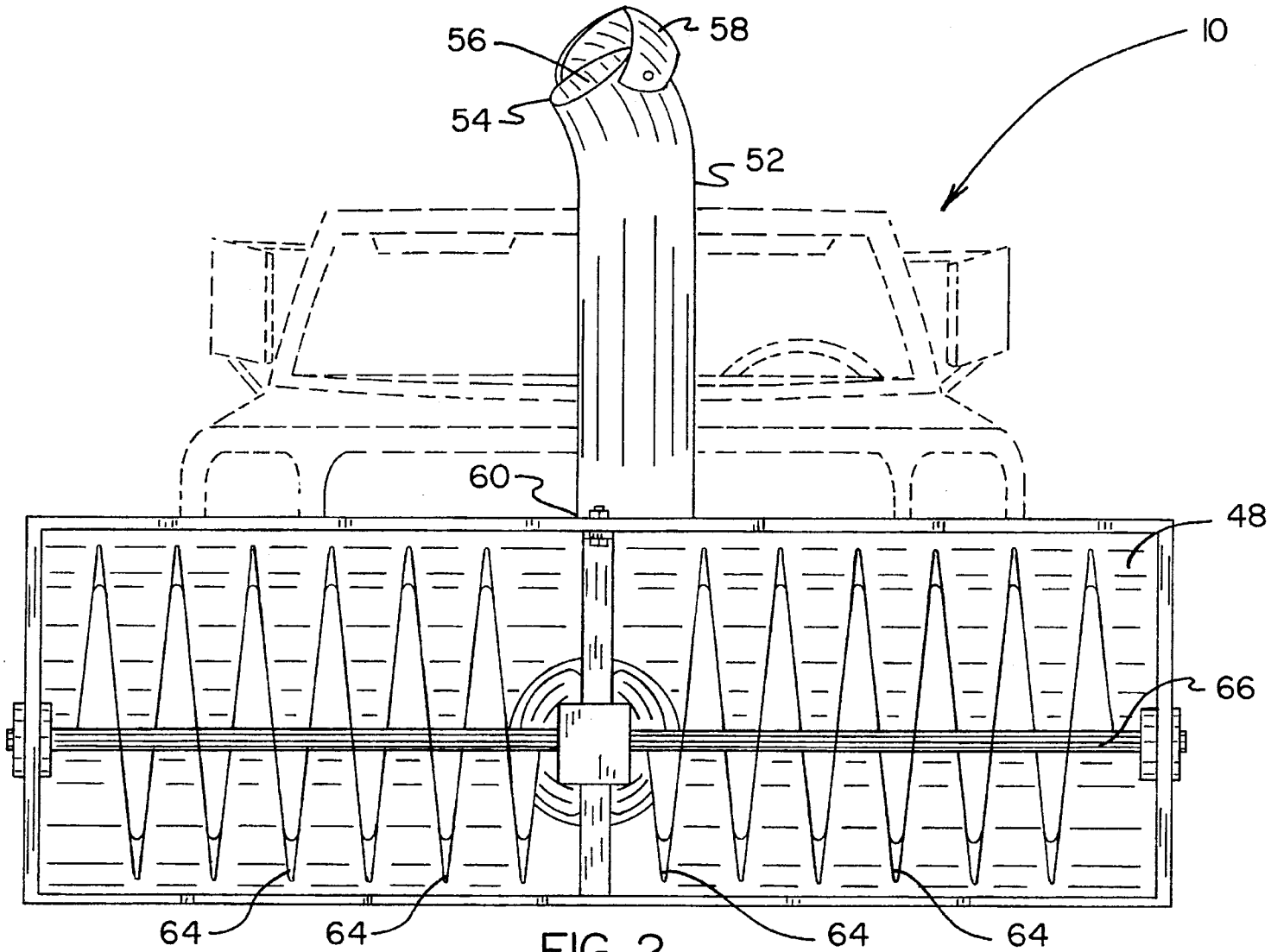
FIG. 2 is a front elevational view of the auger mechanism shown in FIG. 1.
Figure 3:
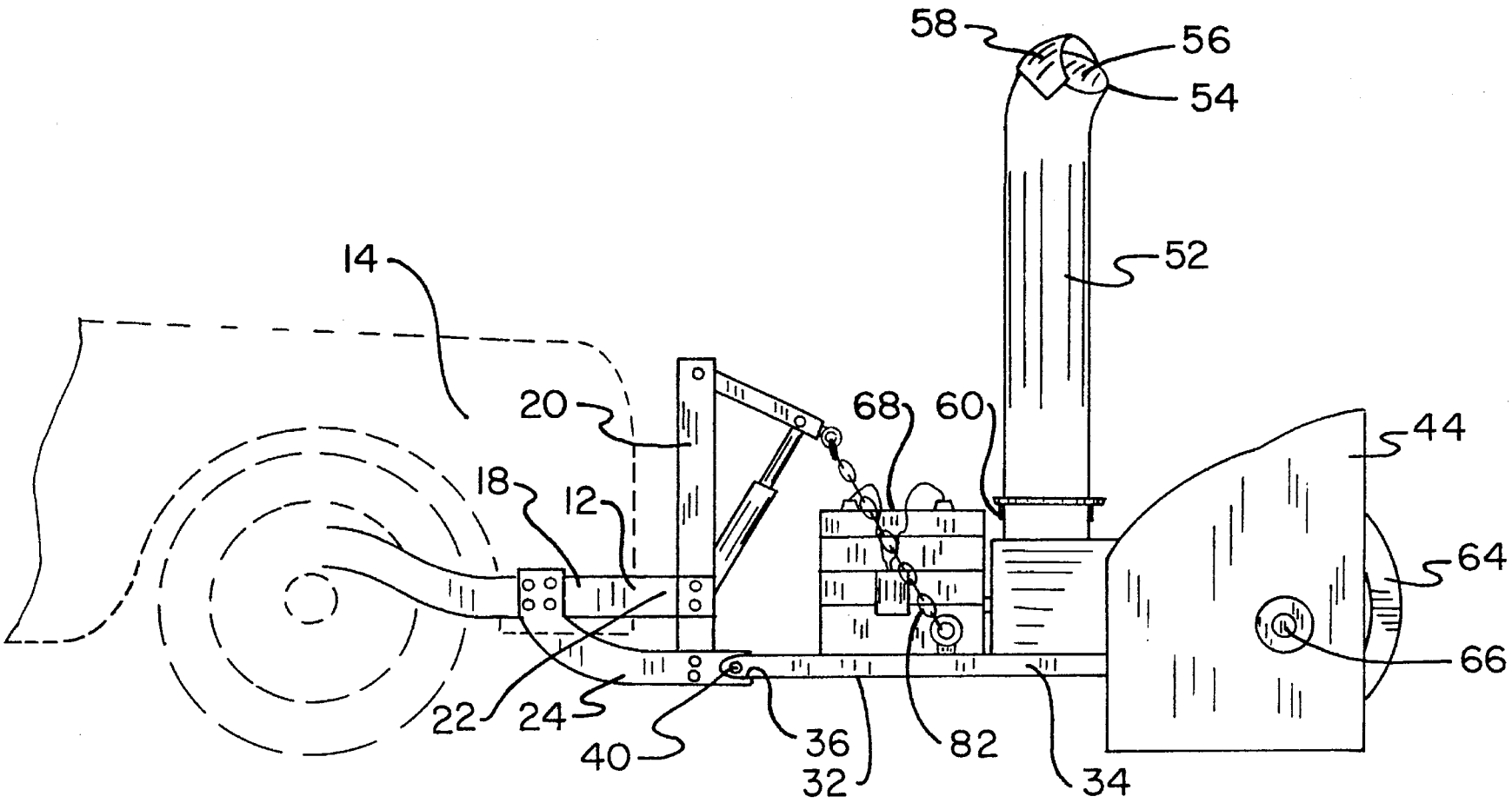
FIG. 3 is a side elevational view of the mechanism illustrated in FIG. 1.

With reference now to the drawings, and in particular to FIG. 1 thereof, the preferred embodiment of the new and improved snowblower attachment for a pickup truck embodying the principles and concepts of the present invention and generally designated by the reference numeral 10 will be described.

The invention, the new and improved snowblower attachment for a pickup truck is comprised of a plurality of components. In their broadest context, such components include a rearward support, a forward support, an auger, a motor, chain supports, a piston and controls. Such components are specifically configured and correlated with respect to each other so as to attain the desired objective.

More specifically, the system 10 of the present invention has as one of its principal components a rearward support 12. The rearward support is coupleable with respect to the front end 14 of a pickup truck 16. It could readily be secured to the front end of any other appropriate vehicle capable of pushing the load for snow blowing purposes. The rearward support includes a central horizontal post 18. Such post is removably attached to the front end of a pickup truck when in use. The post extends forwardly from the center of the front of the pickup truck. Coupled with respect thereto are a pair of vertically extending posts 20. Such posts are spaced parallel with each other. They are secured at a central extent to the forward end 22 of the horizontal posts. Coupled therebetween are lateral supports 24. Such lateral supports have an arcuate shape. They are secured at their rearward ends 26 to an intermediate extent of the horizontal post. At their forward ends 28 they are secured to the lower ends of the vertical posts.

Figure 4:
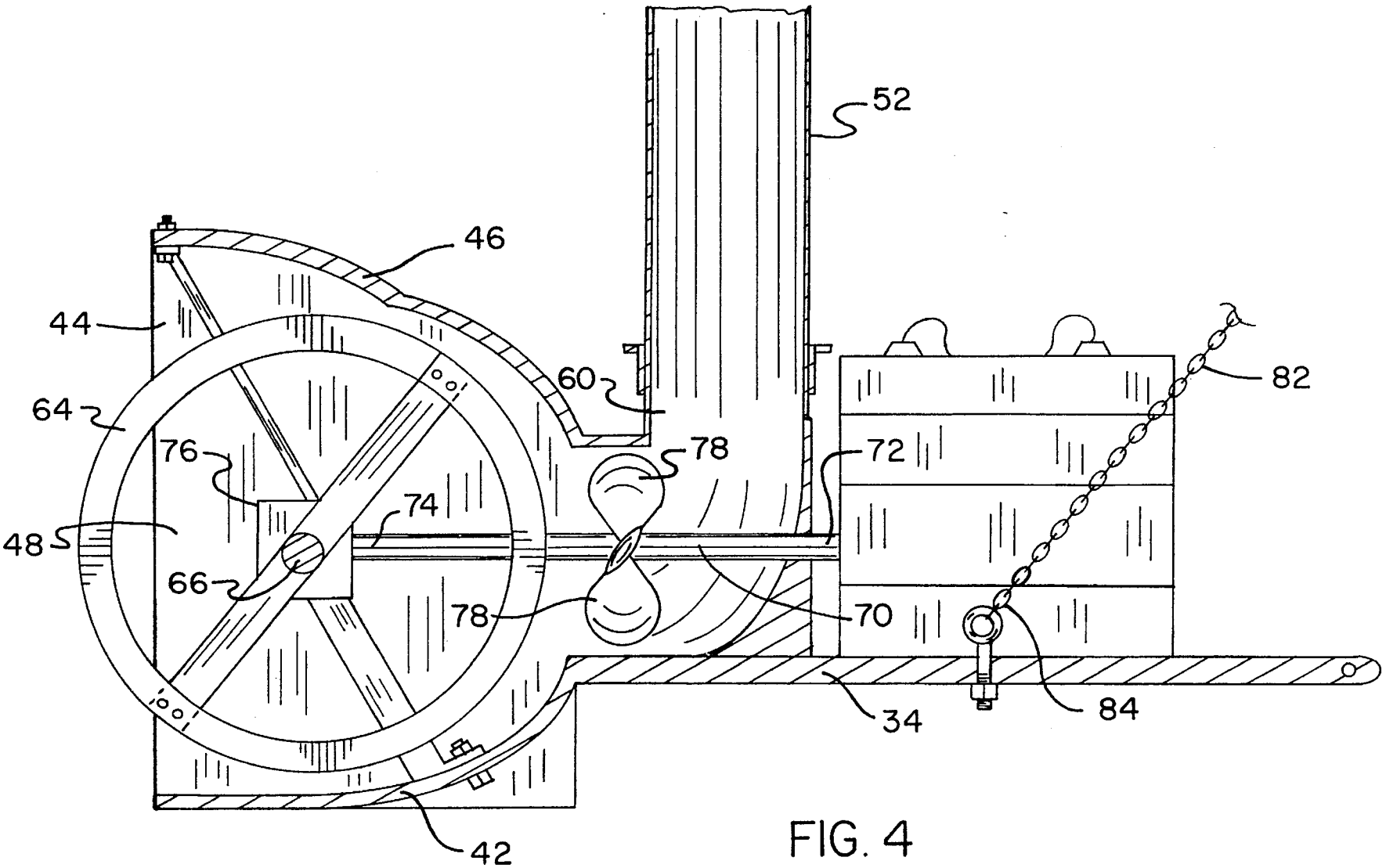
FIG. 4 is an enlarged sectional view of the forward support and components illustrated in FIGS. 1 and 3.
Figure 5:
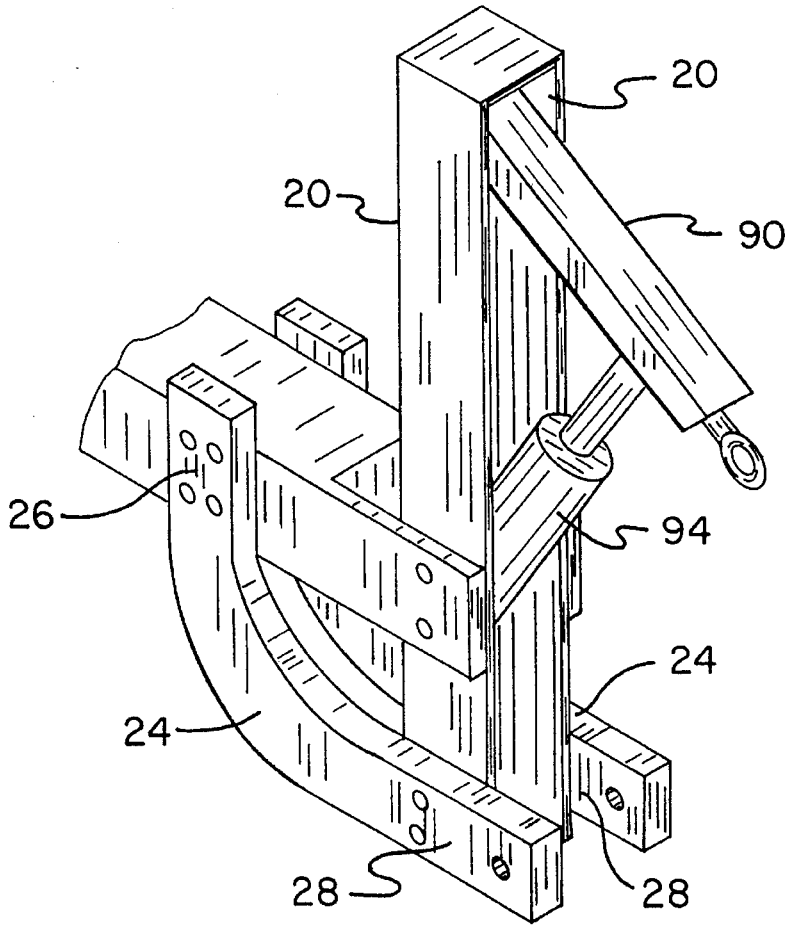
FIG. 5 is a perspective illustration of the rearward support components illustrated in FIGS. 1 and 3.
Figure 6:
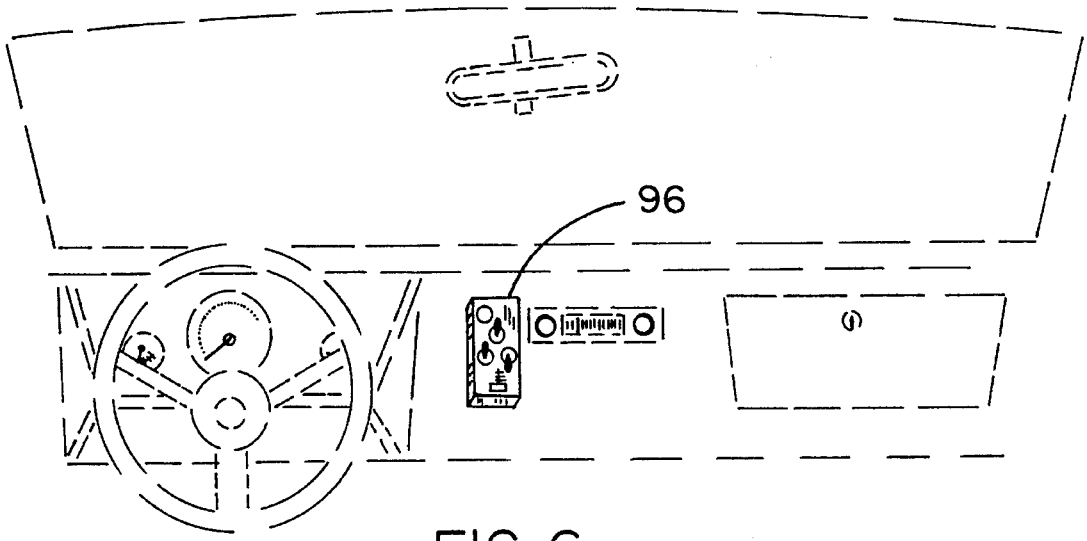
FIG. 6 is a front elevational view of the controls for the device shown in the prior figures.

The next component of the system is a forward support 32. The forward support includes a base plate 34. The base plate has a rearward end 36. A hinge pin 40 couples the rearward end of the forward support with the forward end of the rearward support. The forward support also has a downwardly curved forward end 42. Such forward end provides a curved cross sectional configuration. Note FIG. 4. In addition, parallel side plates 44 are provided at the external sides of the forward end. In addition, a curved upper end 46 forms, in association with the lower curved portion and side panels, a housing 48.

In association with the housing is a chimney 52. The chimney extends in a vertical orientation with an upper free end 54. Such upper free end is formed with a curved end 56. In addition, a pivotable baffle 58 is secured with respect thereto for directing blown snow away from the device. The chimney also has a lower end 60. The lower end of the chimney is in operative association with the rearward end of the housing.

Located within the housing is an auger 64. The auger is positioned in the housing for rotation about a horizontal axis. The auger also includes a horizontal support shaft 66. Such shaft is secured at its opposite ends within the side wall of the housing for rotating the auger within the side plates of the housing. The augers are provided in two symmetric flights which spiral for directing contacted snow toward the center of the housing for being moved upwardly through the chimney and away from the device.

The next major component of the system is a motor 68. The motor is positioned at the rearward end of the forward support. The motor has a drive shaft 70. It also has a first end 72 secured to the motor and a second end 74. The second end is coupled to a gearing assembly 76 adapted to convert the rotation of the shaft 74 into rotation of the auger 64. This is to rotate the augers for blowing snow when in operation and use. A central portion of the drive shaft includes fan blades 78. Such blades are located at an interface location between the housing and the chimney for assisting in the moving of snow being blown.

Next provided is a chain assembly 82. The chain assembly has a pair of chains with their lower ends 84 coupled to the forward support. Their upper ends 86 are secured to a yolk 88. The yolk is at an upper extent adjacent to the vertical posts on a pivot bar 90.

In cooperation therewith is a piston 94. The piston has its lower end secured to an intermediate position between the vertical posts. It has its upper end secured with respect to the yolk through the member 90. As a result, extending or retracting the piston will function to vary the angular orientation of the forward support. This varies the height or depth at which snow will be scraped for being blown.

The last component of the system is a control assembly 96. Such controls are for the motor and piston. They are located within the cab of the pickup truck or other vehicle which is supporting the device. As such, an operator within the vehicle can control the starting and stopping of the motor to effect the rotation of the auger. The operator can also vary the raising and lowering of the auger for more complete control of the system.

The present invention is mounted in front of the vehicle and is powered by its own gasoline engine. Most snowblowers are now self-propelled, but they still require the operator to guide the unit as it spews out the snow through a spout. When the weather is cold and damp, and the wind blowing fiercely, this is not a pleasant chore. The present invention allows the operator to sit in the comfort of a heated cab, sheltered from the elements and watch the spray of snow while it is being blown to the side.

The snowblower auger can be as wide as necessary and is rotated by the integral engine, while the truck is driven along slowly behind it. With the controls mounted in the truck, the blower can be turned on and off, and the discharge can be directed as desired.

Having a snowblower feature incorporated into the snowplow requires less traction than an ordinary plow, which must use the power of the truck to push the snow to the side. Because of this the present invention can be used on lighter vehicles that are normally not suited for use with a snowplow. Large amounts of snow can be moved quickly and easily.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved snowblower attachment for a pickup truck comprising, in combination:

a rearward support couplable with respect to a front end of a pickup truck, the rearward support including a central horizontal post, removably attachable to the front end of the pickup truck and extending forwardly thereof, a pair of vertically extending posts spaced parallel with each other secured at a central extent to a forward end of the horizontal post with lateral supports with an arcuate shape secured at rearward ends thereof to an intermediate extent of the horizontal post and at forward ends thereof to the lower ends of the vertical posts;

a forward support including a base plate having a rearward end with a hinge pin coupling the rearward end of the forward support with the forward end of the rearward support, the forward support having a downwardly curved forward end providing a curved cross-sectional configuration, parallel side plates at external sides of the forward end and an upper curved end forming, in association with a lower curved portion and side panels thereof, a housing, the forward support also having a chimney extending in a vertical orientation with an upper free end formed with a curved end and a pivotable baffle, the chimney also having a lower end in operative association with a rearward end of the housing;

an auger positioned in the housing for rotation about a horizontal axis, the auger also including a support shaft secured rotating the auger within the side plates;

a motor positioned on the rearward end of the forward support, the motor having a drive shaft with a first end secured to the motor and a second end with a gearing assembly adapted to rotate the auger, a central portion of the drive shaft including fan blades located at an interface location between the housing and the chimney;

a pair of chain assemblies having their lower ends coupled to the forward support and having their upper ends secured to a yoke at an upper extent of the vertical posts;

a piston having its lower end secured to an intermediate position between the vertical posts and its upper end secured with respect to the yolk to vary the angular orientation of the forward support; and controls for the motor and piston located within a cab of a vehicle supporting the attachment.

* * * * *